US005570776A

United States Patent [19]

Buchholz et al.

[11] Patent Number: 5,570,776

[45] Date of Patent: Nov. 5, 1996

[54] SWITCH ARRANGEMENT, PARTICULARLY FOR A ROUTER

[75] Inventors: Achim Buchholz, Limburg; Michael Stirm, Oberursel, both of Germany

[73] Assignee: Black & Decker Inc., Newark, Del.

[21] Appl. No.: 397,627

[22] Filed: Mar. 2, 1995

[30] Foreign Application Priority Data

Mar. 3, 1994 [DE] Germany ..... 44 07 418.2

[51] Int. Cl.[6] ..... H01H 9/06

[52] U.S. Cl. ..... 200/43.17; 200/522; 200/334

[58] Field of Search ..... 200/321, 322, 200/330, 331, 332, 332.1, 332.2, 335, 337, 318, 318.1, 318.2, 43.11, 43.16, 43.17, 43.22, 320, 334, 522

[56] References Cited

U.S. PATENT DOCUMENTS

| | | | |
|---|---|---|---|
| 3,767,876 | 10/1973 | Batson | 200/332.1 |
| 3,881,081 | 4/1975 | Schilling et al. | 200/318.1 |
| 5,428,197 | 6/1995 | McCurry et al. | 200/332.2 |

FOREIGN PATENT DOCUMENTS

| | | |
|---|---|---|
| 1015225 | 12/1965 | United Kingdom . |
| 1590290 | 5/1981 | United Kingdom . |
| 2078028 | 12/1981 | United Kingdom . |
| 2145678A | 4/1985 | United Kingdom . |
| 2248987A | 4/1992 | United Kingdom . |
| WO87/04276 | 7/1987 | WIPO . |

*Primary Examiner*—Renee S. Luebke
*Attorney, Agent, or Firm*—Dennis A. Dearing; John D. Del Ponti; Charles E. Yocum

[57] ABSTRACT

A switch arrangement, particularly for a router, is provided with a switch and a pivotable trigger element in a handle arrangement, which can be pivoted against spring force from a release position into a switch operating position and on which is held in a displaceable manner a locking element which in an end position prevents the displacement of the trigger element in the direction of the switch operating position and which by engagement of a gripping area by hand can be displaced against spring force into a first position, in which the trigger element can be pivoted into the switch operating position so that the locking element in a second position locks the trigger element in the switch operating position. The trigger element is substantially L-shaped and is pivotably held at the free end of one of its legs. The locking element is pivotably held at the free end of the other leg and the gripping area of the locking element is located between a pivot connection with the trigger element and a connection area of the legs of the trigger element and at the side remote from the one arm. The locking element on the side with the gripping area is provided between this area and the pivot connection with a locking surface which cooperates with a countersurface of the handle arrangement and the locking element is provided on the side facing towards the one leg between the pivot connection and the connection area of the legs with a locking part which in the second position is in locking engagement with a locking portion of the handle arrangement.

6 Claims, 3 Drawing Sheets

SWITCH ARRANGEMENT, PARTICULARLY FOR A ROUTER

The invention relates to a switch arrangement, particularly for a router with a switch and a trigger element pivotably held in a handle arrangement, which trigger element can be pivoted against spring force from a release position into a switch operating position and on which is held in a displaceable manner a locking element which in an end position prevents the displacement of the trigger element in the direction of the switch operating position and which by engagement of a gripping area by hand can be displaced against spring force into a first position, in which the trigger element can be pivoted into the switch operating position so that the locking element in a second position locks the trigger element in the switch operating position.

In a known switch arrangement (German Patent Application P 23 15 841.0) for an angle grinder and the like the trigger element consists substantially of a rectilinear lever which is pivotably mounted at its rear end at the gripping area of the angle grinder and which can be pivoted against spring force for activating the switch. A blocking slider which can be displaced against spring force is held in the area of the free end of the trigger element. The blocking slider in its one end position prevents the trigger element from being pivoted into the switch operating position in that a stopping block provided at the blocking slider is located opposite a stationary hook component secured to the angle grinder and comes into contact with this preventing a pivoting movement of the trigger element if an attempt is made to pivot it.

To move the trigger element into the switch operating positon first of all the blocking slider must be moved manually by the operator outwards against spring force, i.e. in the direction of the longitudinal extension of the trigger element and away from its pivot axis so that the stopping block comes out of the area of the stationary hook component. If the trigger element is then pivoted into the switch operating position, by a further movement of the blocking slider outwards and a subsequent slight return pivoting of the trigger element in the direction of the release position the stationary hook component can be engaged with a hook area of the blocking slider and consequently the trigger element can be locked in the switch operating position.

Apart from the fact that the known switch arrangement and particularly its combination of trigger element and locking element formed by the blocking slider is very bulky, the type of operation of the locking element is awkward as the operator has to move the locking element with the fingers of one hand which grip the trigger element outwards, i.e. in a direction which is vertical to the direction of the curved movement of the fingers.

The object of the invention is to provide for a reliable switch arrangement which can be operated simply. To achieve this objective a switch arrangement of the type mentioned in the introduction is constructed according to the invention in such a way that the trigger element is substantially L-shaped and is held at the free end of one of its legs so that it can be pivoted, that the locking element is held pivotably at the free end of the other leg, that the gripping area of the locking element is located between a pivot connection with the trigger element and a connection area of the legs of the trigger element and at the side remote from the one leg, that the locking element on the side with the gripping area is provided between this area and the pivot connection with a locking surface which cooperates with a countersurface of the handle arrangement and that the locking element is provided on the side facing towards the one leg between the pivot connection and the connection area of the arms with a locking part which in the second position is in locking engagement with a locking portion of the handle arrangement.

In the switch arrangement according to the invention the trigger element is thus substantially L-shaped as a result of which the operator can handle the outer side of the one leg with the fingers of one hand and can pivot the trigger element out of its release position into a switch operating position. At the same time he can use the gripping area of the locking element located on the outside using the thumb of the same hand to move the locking element into the first position so that the locking surface of the locking element can come out of the area of the countersurface of the handle arrangement and the trigger element can be moved into the switch operating position. A locking engagement with a locking portion of the handle arrangement can be effected in the second position by a locking part provided at the locking component.

In a simple manner the locking surface can be formed by a step in the locking component.

The locking part can be hook-shaped and the locking element in the second position can be pivoted over the first position out of the end position so that the trigger element in the second position of the locking element from the maximum possible pivoting from the release position is slightly pivoted back in the direction of this. In this way the locking engagement with the locking portion of the handle arrangement is effected in the second position.

The locking portion of the handle arrangement can be provided with a ramp surface, with which the locking part comes into engagement when the locking element is displaced into the first position so that the locking element cannot be displaced outwards over the first position but a pivoting of the locking element in the direction of the second position is only possible after the locking element has run over the end of the ramp surface.

An actuator part can be provided on the side of the one leg of the trigger element which is facing towards the other leg of the trigger element. This actuator part is in engagement with the actuator arm of a rod element which is held in the handle arrangement so that it can be rotated about its longitudinal axis and which is coupled mechanically to the switch so that when the trigger element is moved from its release position the rod element is rotated so as to act on the switch and to bring it into its operating position. The rod element can for example be provided for this purpose at its end facing away from the actuator arm with an actuator surface for engagement with the switch pusher.

The invention will be explained in greater detail below on the basis of figures which show an embodiment schematically.

Figure 1:
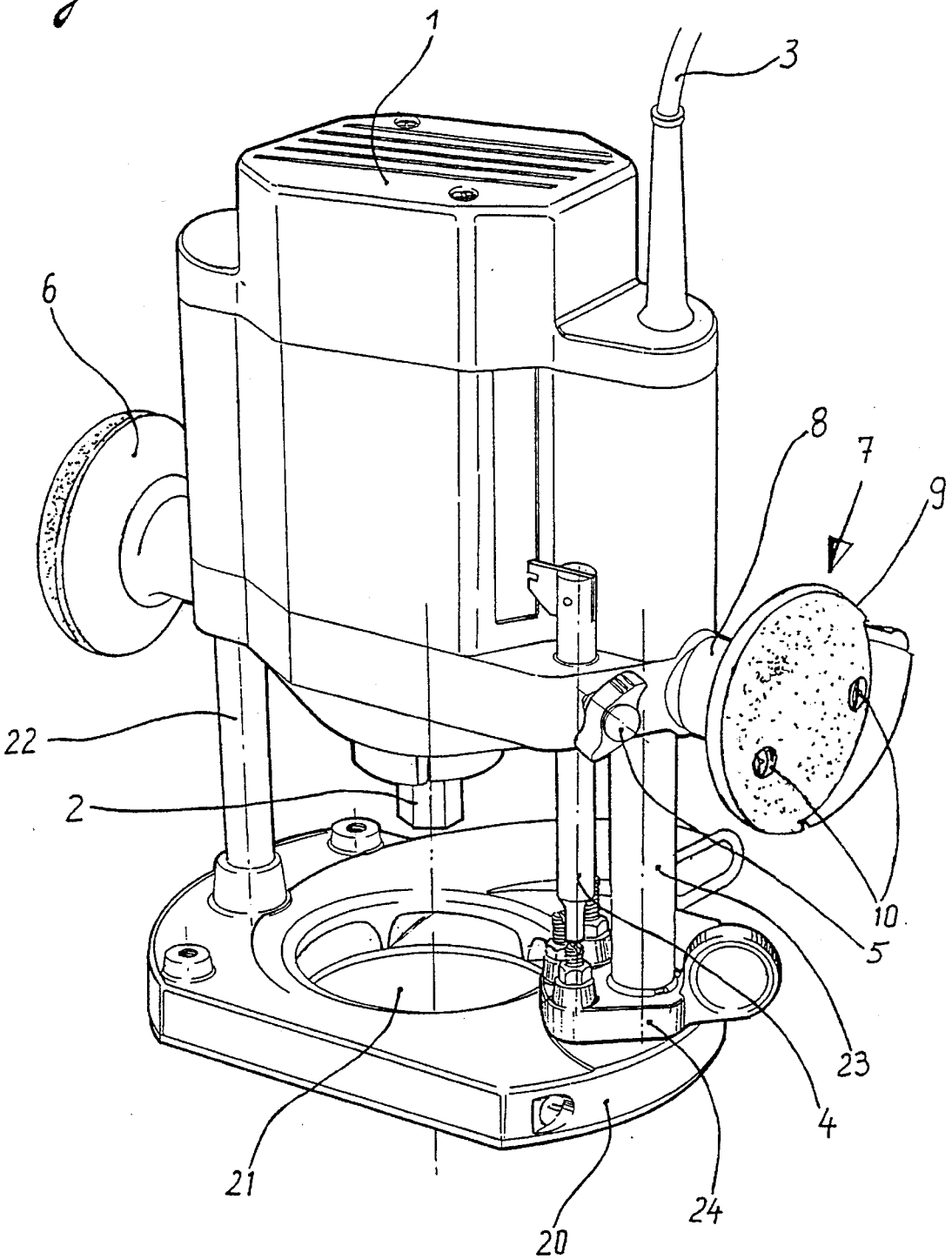
FIG. 1 shows a perspective view of a router with a trigger element held in a handle.

The router shown in FIG. 1 is provided with a cutter head 1 which contains the electric motor which is not shown, from which a tool holder 2 protrudes and on which two handles 6 and 7 are disposed laterally. An electric connection cable 3 as shown is run into the cutter head in order to connect the electric motor to the power supply via a switch arrangement which is still to be described.

The cutter head is located vertically, as is usual with routers, in a displaceable manner at two guide columns 22 and 23 which are secured to a base 20, the central opening 21 of which is located beneath the tool holder 2 so that a tool bit, a cutter or the like inserted in the tool holder 2 can extend through the central opening 21 and into a workpiece to be processed.

A depth adjustment device is provided for limiting the lowering movement of the cutter head 1 and this depth adjustment device has an adjusting rod 23 which can be fixed in a desired height position by means of a clamping screw 5 at the cutter head 1 so that this adjusting rod, during the lowering of the cutter head 1, comes to bear with its lower end on an adjustment stop which is seated on an adjustment ring which is disposed in a rotatable manner about the one guide column 23. This adjustment ring carries three adjustment stops consisting of screw bolts which can be adjusted to different heights so that three different lowering positions are obtained for the cutter head 1 by means of a corresponding positioning of the adjustment ring.

Figure 2:
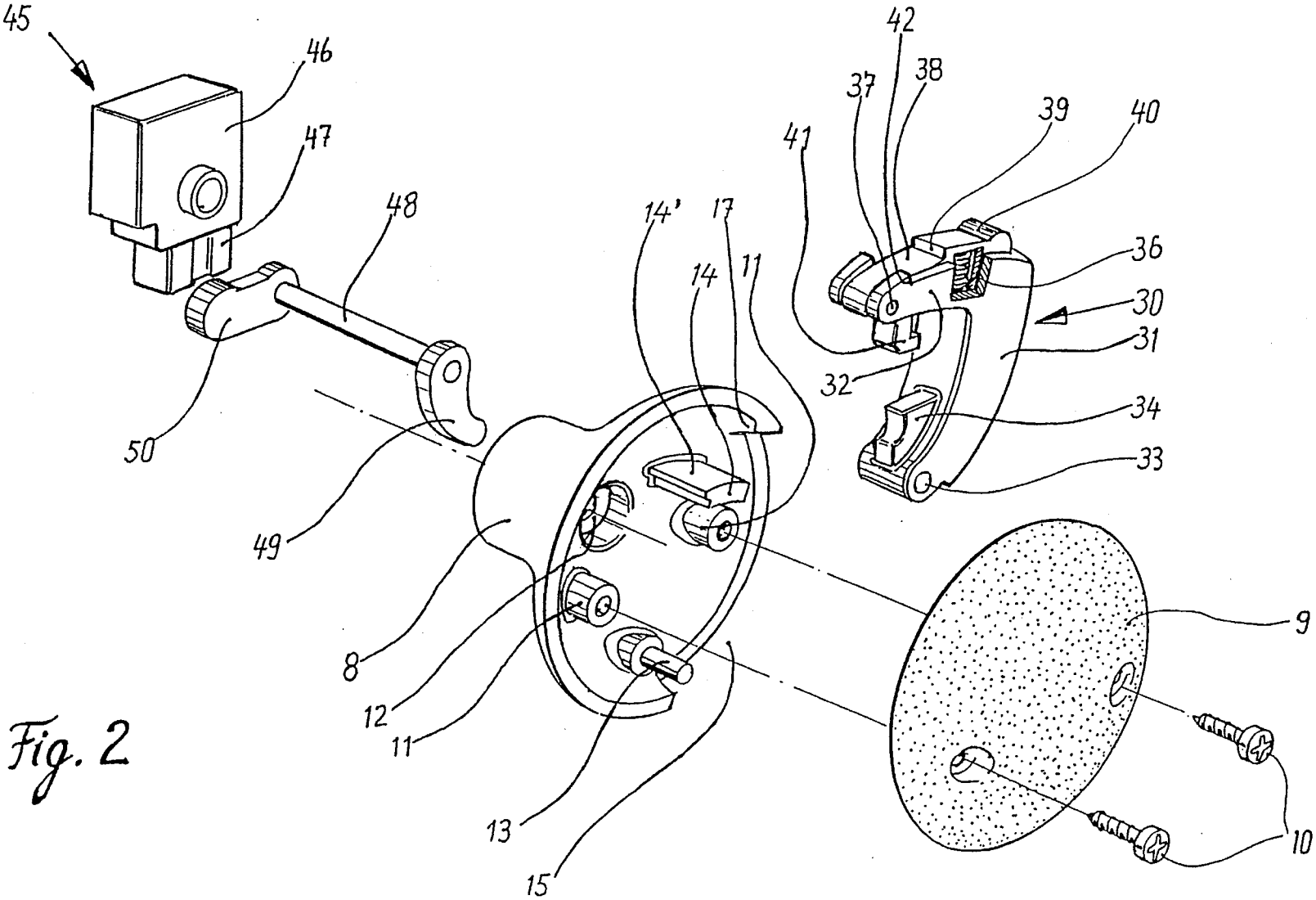
FIG. 2 shows an exploded view of parts of the switch arrangement and the handle arrangement.

The switch arrangement contains a switch 45 shown in FIG. 2 with a housing 46 and a switch pusher 47 which can be moved against spring pressure, which in its position pressed into the switch housing 46 closes the switching contacts. The switch 45 is located adjacent to the handle 7 inside the cutter head 1 and with the switch pusher 47 pushed in provides in the usual manner the electrical connection between connection cable 3 and the electric motor located in the cutter head 1.

The handle 7 consists of a handle part 8 and a cover 9 which can be screwed on to the handle part 8 with screws 10, for which the handle part 8 is provided with protrusions 11 with threaded bores into which the screws 10 can be screwed. As shown in FIG. 2 a hollow space is formed in the handle 7 between the cover 9 and the handle part 8, from which a through-hole 12 extends through the handle part 8. A receiving pin 13 is located in the hollow space which extends to near the cover 9 when the cover 9 is fitted, which is formed on the handle part 8 and which runs parallel to the longitudinal axis of the through-hole 12. A protrusion 14 is also provided in the hollow space which forms part of the handle part 8 and on the side of which facing away from the receiving pin 13 a ramp surface 14' is formed.

In the assembled state a rod element 48, which carries non-rotatably an actuator arm 49 at the end located in the hollow space, extends through the central bore 12 so that it is rotatably held. At the opposite end an actuator surface is formed by a non-rotatable arm 50 so that this surface is in engagement with the outer end of the switch pusher 47.

Figure 3:
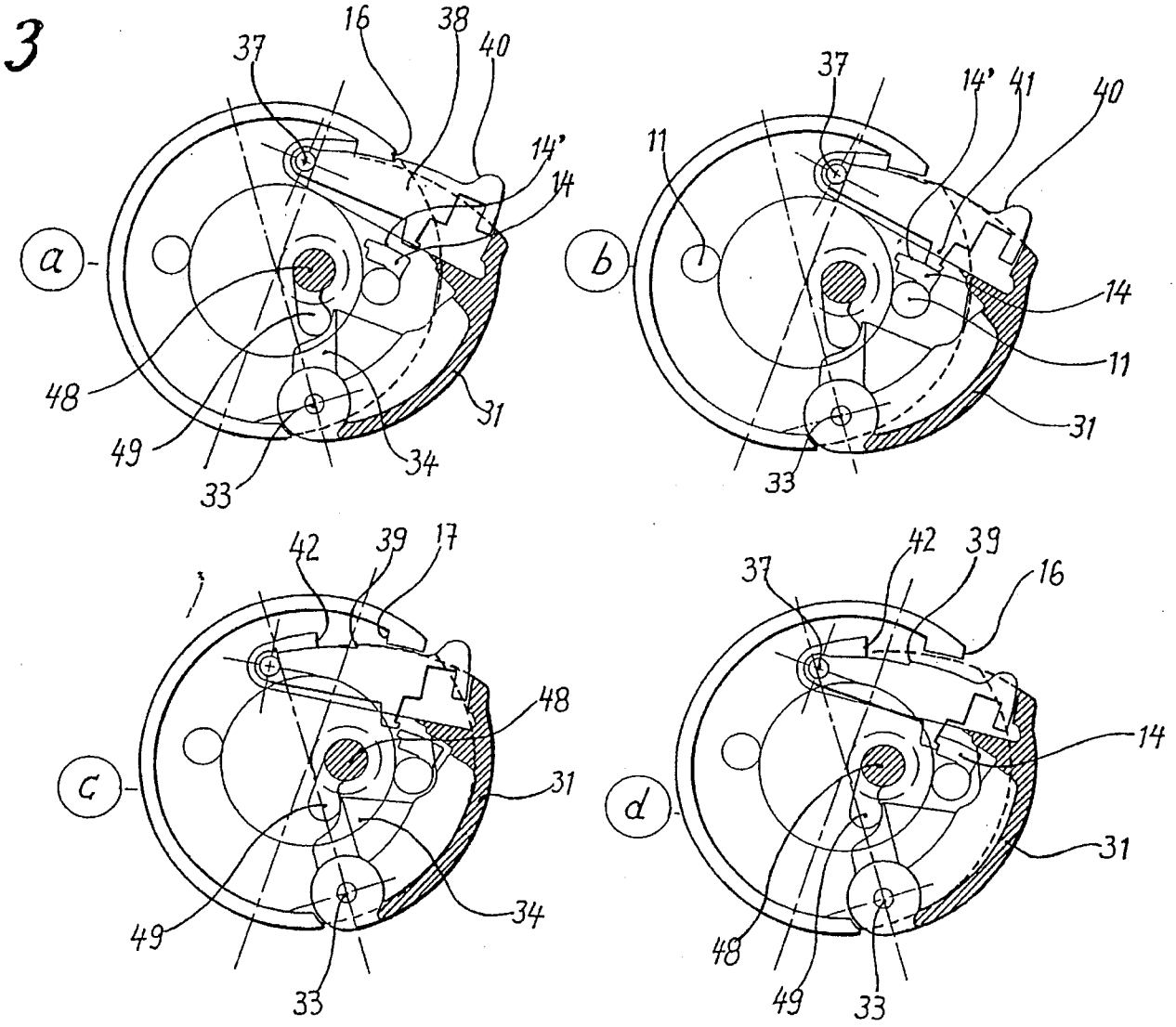
FIG. 3(*a* to *d*) show various operating positions of the switch arrangement with individual components having shapes which differ somewhat from the shapes of the components according to FIG. 2.

A cutaway portion 15 is provided in the peripheral area of the wall of the handle part 8 adjacent to the hollow space and a trigger element 30 with a through-hole 33 is placed pivotably on the receiving pin 13 so that this trigger element protrudes outwards in part through the cutaway portion 15. The trigger element 30 is substantially L-shaped and the through-hole 33 is located at the free end of the leg 31 of the trigger element 30. The other leg 32 of the trigger element 30 is forked and receives a locking element 38 between its two sections which is held at the free end of the leg 32 pivotable about a pin 37 and extends in the direction of the connecting area of the two legs 31 and 32. A helical spring 36 is supported at the trigger element 30 and is in engagement with the locking element 38 so that this is loaded about the pin 37 in anticlockwise direction (FIGS. 2 and 3). A formed actuator part 34 is located adjacent to the through-hole 33 on the inner side of the leg 31, i.e. the side which is facing towards the leg 32.

When the trigger element 30 is inserted into the hollow space of the handle 7 by pushing onto the receiving pin 13 and securing the cover 9, a part of its leg 31 and a part of the locking element 38 protrude from the handle 7 whilst the actuator part 34 is in engagement with the outer end of the actuator arm 49 of the rod element 48. The free end of the leg 32 of the trigger element 30 extends between the peripheral wall of the handle part 8 defining the hollow space and the ramp surface 14' formed by the protrusion 14. The peripheral wall of the handle part 8 forms at its end adjacent to the locking element 38, as can be seen particularly in FIG. 3, an outer located countersurface 16 and an inner located countersurface 17. These two countersurfaces protrude into an area of the outer surface of the locking element 38 adjacent to them which area, as seen from the pin 37, is provided with a holding surface 42, which cooperates with the inner countersurface 17, a locking surface 39, which is formed by a step and which cooperates with the outer countersurface 16, and with a gripping area 40. A hook-shaped locking part 41 is formed on the surface of the locking element 38 opposite the outer surface and this part 41 is located in relation to the pin 37 on the same side as the countersurfaces 16 and 17 and the gripping area 40.

When the trigger element 30 is located in the release position as shown schematically in FIG. 3*a*, it is pivoted to the farthest extent in clockwise direction about the receiving pin 13 and the pivoting movement is limited by the contact of the holding surface 42 of the locking element 38 at the inner countersurface 17 of the handle part 8. An inadvertent pressing in of the trigger element 30, i.e. a pivoting about the receiving pin 13 in an anticlockwise direction (FIG. 3) is not possible as then the locking surface 39 of the locking element 38 would come into blocking contact at the outer countersurface 16 of the handle part 8.

In order to move the trigger element 30 into the switch operating position, the operator with his hand gripping the handle 7 moves the locking element 38 by finger pressure on to the gripping area 40 against the action of the spring 36 in clockwise direction. Thereby the locking surface 39 is released from the outer countersurface 16 (FIG. 3*b*) and the trigger element 30 is pivoted in counterclockwise direction (FIG. 3*c*) by the application of pressure on to the outer side of its leg 31 so that this movement as a result of the engagement of the actuator part 34 with the actuator arm 44 results in a rotation of the rod element 48 and thus a movement of the switch pusher 47 against spring pressure into the switch housing 46. At the same time the pivot movement of the locking element 38 is limited in that the free end of the hook-shaped locking part 41 comes in engagement with the ramp surface 14' formed by the protrusion 14 (FIG. 3*b*).

As can be seen in FIG. 3*c* the trigger element 30 can be pivoted into the hollow space of the handle 7 to the extent that the hook-shaped locking part 41 reaches out over the ramp surface 14' of the protrusion 14 and thus over the inner end of the protrusion 14. If the operator releases the trigger element 30 in this position, as a result of the spring tension acting on the switch pusher 47, it will be pressed again into the release position (FIG. 3*a*) by the corresponding rotation of the rod element 48 and the locking element 38 will, as a result of the tension of the spring 36, move into its initial position, in which the cooperation of locking surface 39 and outer countersurface 16 will prevent an inadvertent movement of the trigger element 30 into the switch operating position.

When the switch arrangement shall be locked in the switch operating position, in the position according to FIG. 3*c* the operator can pivot the locking element 38 further about the pin 37 in clockwise direction by pressing down so that the hook area of the hook-shaped locking part 41 reaches into the area of a step at the protrusion 14 and engages this in a locking manner after a slight release of the trigger element 30 and the resulting pivoting about the receiving pin 13 in a clockwise direction (FIG. 3*d*). The switch 45 is held closed in this locked position. As soon as the operator then pivots slightly the trigger element 30 in the anticlockwise direction the hook area of the locking part 41 of the locking element 38 is released from the step of the protrusion 14 and the force of the spring 36 pivots the locking element 38 into the position according to FIG. 3*c* so that with the release of the trigger element 30 this returns into the release position according to FIG. 3*a* in the manner described above.

I claim:

1. A switch arrangement for a router, comprising a spring biased switch (45) and a trigger element (30) which is pivotably held in a handle arrangement (7) adapted to be mounted on said router, which trigger element is pivotable against said spring biased switch from a release position into a switch operating position and on which is held in a displaceable manner a locking element (38) which in an end position prevents displacement of the trigger element (30) in the direction of the switch operating position and which by engagement of a gripping area (40) on the locking element by hand is displaceable against a spring member into a first position, in which the trigger element (30) is pivotable into the switch operating position so that the locking element (38) in a second position locks the trigger element (30) in the switch operating position, characterised in that the trigger element (30) includes legs connected at a connection area in a substantially L-shaped configuration and is pivotably mounted about a pivot connection (37) at the free end of one of its legs (31), that the locking element (38) is pivotably held at the free end of the other leg (32), that the gripping area (40) of the locking element (38) is located between the pivot connection (37) with the trigger element (30) and the connection area of the legs (31, 32) of the trigger element (30) and at a side remote from the one leg (31), that the locking element (38) on the side with the gripping area (40) is provided between this area and the pivot connection (37) with a locking surface (39) which cooperates with a countersurface (16) on the handle arrangement (7) and that the locking element (38) is provided on the side facing towards the one leg (31) between the pivot connection (37) and the connection area of the legs (31, 32) with a locking part (41) which in the second position is in locking engagement with a locking portion (14) on the handle arrangement (7).

2. A switch arrangement according to claim 1, characterised in that the locking surface (39) is formed by a step in the locking element (38).

3. A switch arrangement according to claim 1, characterised in that the locking part (41) is hook-shaped, that the locking element (38) in the second position is pivoted over the first position out of the end position and that the trigger element (30) in the second position of the locking element (38) is positioned slightly pivoted back from a maximum extent from the release position such that the locking part engages the locking portion (14) on the handle arrangement.

4. A switch arrangement according to claim 3, characterised in that the locking portion (14) of the handle arrangement (7) is provided with a ramp surface (14'), with which the locking part (41) comes into engagement when the locking element (38) is displaced into the first position and that the locking element (38) after the hook-shaped locking part (41) has run over the end of the ramp surface (14') is pivotable in a direction of the second position.

5. A switch arrangement according to claim 1, characterised in that on the side of the one leg (31) which is facing towards the other leg (32) of the trigger element (30) an actuator part (34) is provided and this actuator part (34) is in engagement with an actuator arm (49) of a rod element (48) which is mounted in the handle arrangement (7) for rotation about a longitudinal axis and which is coupled mechanically to the switch (45).

6. A switch arrangement according to claim 5, characterised in that the rod element (48) is provided at an end opposite the actuator arm (49) with an actuator surface adapted to engage a switch pusher (47) on the spring biased switch (45).

* * * * *